US005176216A

United States Patent [19]

Slater et al.

[11] Patent Number: 5,176,216

[45] Date of Patent: Jan. 5, 1993

[54] BYPASS SEATING NIPPLE

[75] Inventors: John P. Slater, Guymon; Daryl K. Duvall, Oklahoma City, both of Okla.

[73] Assignee: Oxy USA, Inc., Oklahoma City, Okla.

[21] Appl. No.: 721,108

[22] Filed: Jun. 26, 1991

[51] Int. Cl.[5] ..... E21B 43/10

[52] U.S. Cl. ..... 166/105.5; 166/115

[58] Field of Search ..... 166/265, 306, 105.5, 166/106, 114, 115, 51

[56] References Cited

U.S. PATENT DOCUMENTS

| | | | |
|---|---|---|---|
| 3,167,125 | 1/1965 | Bryan | 166/45 |
| 3,282,341 | 11/1966 | Hodges | 166/115 X |
| 3,333,638 | 8/1967 | Bishop | 166/42 |
| 3,362,477 | 1/1968 | Brandt | 166/42 |
| 3,627,046 | 12/1971 | Miller et al. | 166/51 X |
| 3,887,342 | 6/1975 | Bunnelle | 55/203 |
| 4,273,191 | 6/1981 | Hradel | 166/305 |
| 4,296,810 | 10/1981 | Price | 166/265 |
| 4,393,927 | 7/1983 | Singer | 166/105 |
| 4,429,740 | 2/1984 | Malinchak | 166/53 |
| 4,569,396 | 2/1986 | Brisco | 166/305 |
| 4,799,544 | 1/1989 | Curlett | 166/65.1 |

*Primary Examiner*—William P. Neuder

*Attorney, Agent, or Firm*—Head & Johnson

[57] ABSTRACT

A downhole or subterranean tool for use with a subsurface strata producing both hydrocarbon gas and water in which the gas and water are separated downhole by gravity and the gas is produced to the surface through one channel, and the water is disposed into a lower subterranean disposal zone. A production tubing is suspended within a casing which lines a well bore drilled through the two zones. A sucker rod actuated reciprocating pump is located in the production tubing. A seating nipple bypass tool with longitudinal holes and side ports in the wall thereof surrounds the pump. This bypass tool is positioned between the producing zone and a lower zone which is to be used as a disposal zone for the salt water. Gas is produced upwardly through the annulus between the tubing and the casing, and the salt water is flowed down through the longitudinal tubes in the sleeve to be disposed in the lower zone.

3 Claims, 2 Drawing Sheets

BYPASS SEATING NIPPLE

BACKGROUND OF THE INVENTION

1. Field of the Invention

The present invention relates to apparatus for use in oil and gas wells where a producing zone produces both hydrocarbon fluids (such as gas) and water and in which the water is disposed in a downhole disposal zone without pumping to the surface.

2. Background Description

Oil and gas and other minerals are found in subterranean strata or stratum, or layers. To produce the wanted products, wells are drilled from the surface down through those strata. These strata layers that are sought contain, for example, hydrocarbon fluids such as gas which may be produced to the surface and burned to heat homes, factories, etc. or used in various chemical processes. These wells are lined with heavy steel pipe called "well casing." They are usually cemented in place so that fluids cannot escape or flow along the space between the casing and the borehole wall.

Unfortunately, essentially all gas producing stratum contains unwanted material such as salt water or brine which is produced into the well bore along with the gases. It is a common practice to produce the hydrocarbon fluids and the salt water to the surface where the water is separated out. The water is very frequently then injected through another well which has been drilled to a disposal zone which is deep within the earth. This method is quite expensive inasmuch as it requires the drilling of an additional well.

In some published methods, the salt water is separated downhole in the casing from the hydrocarbon fluid. The mixture of the hydrocarbon fluid and water is forced through perforations of the wall of the casing into the interior of the casing where the water is separated out by gravity inasmuch as it is heavier than the hydrocarbon fluid. In some cases the water disposal zone may be located beneath the producing zone. Sometimes in such cases the operator will install a downhole pump so that the separated water may be forced into the lower disposal zone as shown in U.S. Pat. No. 3,167,125.

DISCLOSURE STATEMENT

A patentability search revealed the patents listed on the attached form PTO-1449. These various patents individually and collectively relate to subterranean well producing fluids such as hydrocarbons and water. Perhaps the most pertinent of these patents to the present application is U.S. Pat. No. 3,167,125 to W. P. Bryan, issued Jan. 26, 1965. In the method described in this patent, there is formed a seal in the well bore between an upper production stratum and a lower disposal stratum. The heavier unwanted precipitates such as salt water and the lighter desirable portions of the yield from the productive zone is allowed to stratify in the well bore. Substantially only the unwanted portion of the stratified yield (such as salt water) from a point in the well bore above the seal is mechanically pumped into the disposal stratum.

SUMMARY OF THE INVENTION

This invention relates to a downhole apparatus and procedure for downhole disposing of salt water without bringing it to the surface. Before my system is used, a well is drilled in the surface down through various subterranean formations. One such formation would be a producing formation in which oil and gas or other hydrocarbon fluids may be contained and in which there is also a large amount of water. There is also provided a so-called salt water disposal zone which is below and separated from the producing zone. A production string of tubing is suspended within the casing. At the lower end of the casing there is provided a seating nipple bypass tool which has longitudinal passages in the wall thereof and extend from one end to the other. There is also a horizontal port extending through the wall but does not intercept the longitudinal passages. Within this bypass tool there is provided a pump, and particularly a pump driven by reciprocating rods which extend up through the tubing to the surface. Other type pumps could be used. Producing perforations which are holes in the casing are provided in the casing adjacent the producing zone. Adjacent the disposal zone are provided disposal perforations in the casing. When the water and the hydrocarbon fluid such as gas is produced into the annulus between the tubing string and the casing, the heavier fluid, which is salt water, will settle to the lower part of the casing hole above a packer which stops the downflow of produced water. A passage is provided from the annulus through the side ports of the bypass tool to the inlet of the pump. The outlet of the pump is in fluid communication with the longitudinal passages at the top of the bypass tool. The lower end of the longitudinal passages opens into the casing below a packer which seals the space between the sleeve and the interior of the casing.

In operation, fluid (including salt water and hydrocarbon fluid) flows in through the production perforations to the annulus. The hydrocarbon fluid such as gas being lighter, rapidly ascends to the top of the well through the annulus where it is recovered in a normal manner. The salt water which settles in the lower end of the casing above the packer then enters through the side ports to the lower intake of the pump where it is pumped up through the pump into the tubing. It then flows from the tubing down the longitudinal holes in the sleeve outwardly into the casing below the packer and through the perforated casing into the disposal zone.

An object of this invention is therefore to provide an improved system for separating salt water from hydrocarbon fluids such as gas and disposing of it downhole.

DETAILED DESCRIPTION OF THE INVENTION

Figure 1:
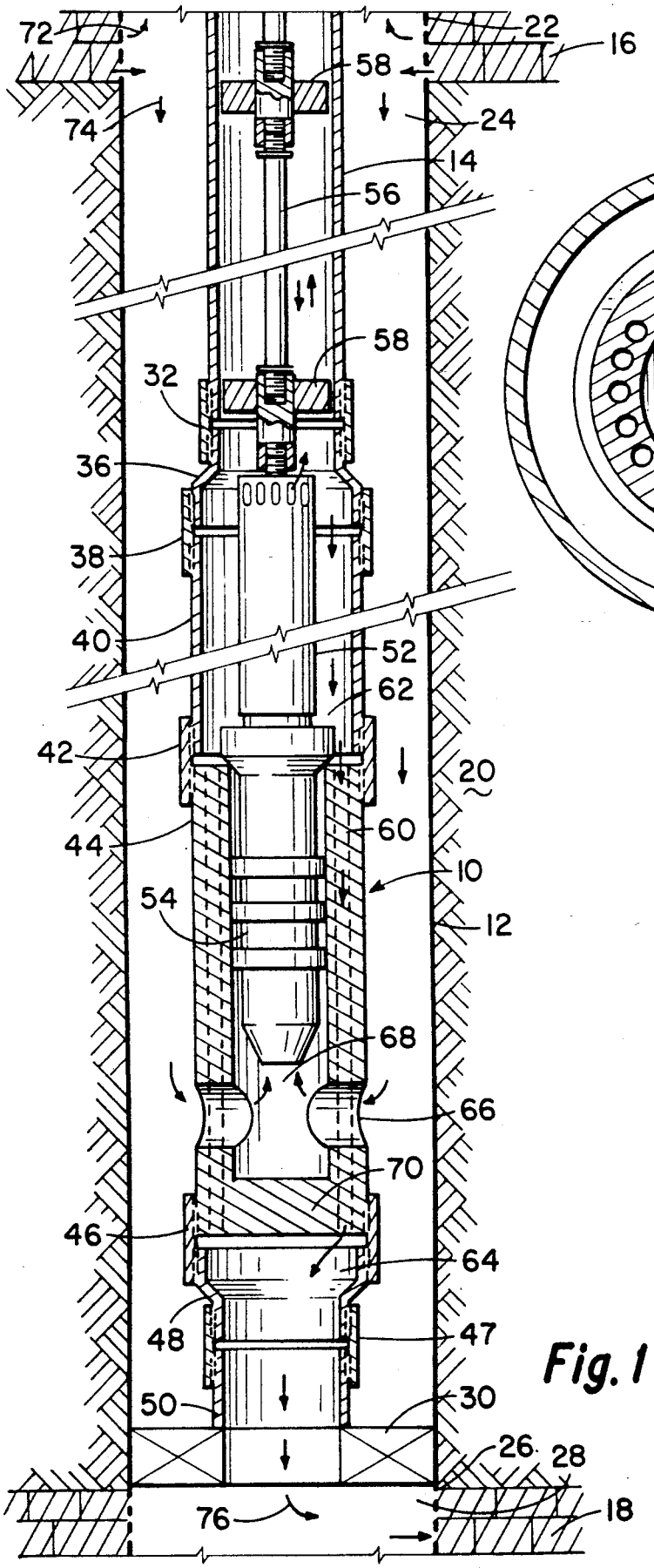
FIG. 1 is a downhole view partly in vertical section showing the seating nipple bypass tool of this invention inserted with a submersible rod-driven pump suspended at the lower end of a string of tubing in a well bore.

Shown in FIG. 1 is a cylindrical seating nipple bypass tool 10 suspended in casing 12 at the lower end of a tubing string 14. The casing 12 is suspended or set in a borehole drilled from the surface of the earth through a productive stratum or zone generally referred to by the reference numeral 16 and a lower disposal zone or stratum generally referred to by the reference numeral 18.

These stratums are separated by an impermeable zone or layer 20 which may be a shale formation. It is conventional practice to cement the casing in the well bore by pumping cement between the casing and the borehole wall. This is to prevent passage of fluid in this space. As shown in FIG. 1, perforations 22 connects the annulus 24 between the casing 12 and tubing 14 with the upper production zone 16. Likewise, lower perforations 26 connects the space 28 in the casing below packer 30 with the lower disposal stratum 18.

A collar 32 connects the lower end of tubing 14 to a swedge 36. The tubing is typically $2\frac{7}{8}''$ with the swedge being a $3\frac{1}{2}''\times2\frac{7}{8}''$ male-to-male swedge. The lower end of the swedge 36 is connected to tubing 40 by a collar 38. The collar and tubing 40 are typically $3\frac{1}{2}''$ to match the swedge 36. The lower end of tubing 40 is connected by collar 42 to seating nipple bypass tool 44. The lower end of its bypass seating nipple 44 is connected by collar 46 to a male-to-male swedge 48 which connects to a J-latch on-off tool 50. A production packer 30 is supported at the lower end of J-latch tool 50 and seals the lower end of annulus 24 between the tubing string and the casing 12.

An insert pump 52 is suspended within tubing section 40 at the lower end of pumping rods 56. As shown, pumping rod 56 has rod guides 58 within the tubing 14. These rods extend to the surface where they are connected to reciprocating means not shown which causes the rod to reciprocate in the tubing and thus causes the downhole pump to operate to pump fluid. The pump 52 is held in position by a conventional pump hold-down assembly 54. All of the compounds shown in FIG. 1 except for the bypass seating nipple 44 are commercially available.

Figure 3:
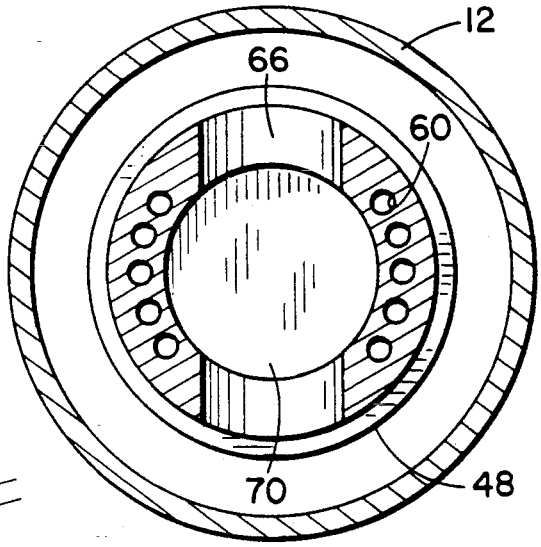
FIG. 3 is a cross-sectional view along the line 3—3 of FIG. 2.
Figure 2:
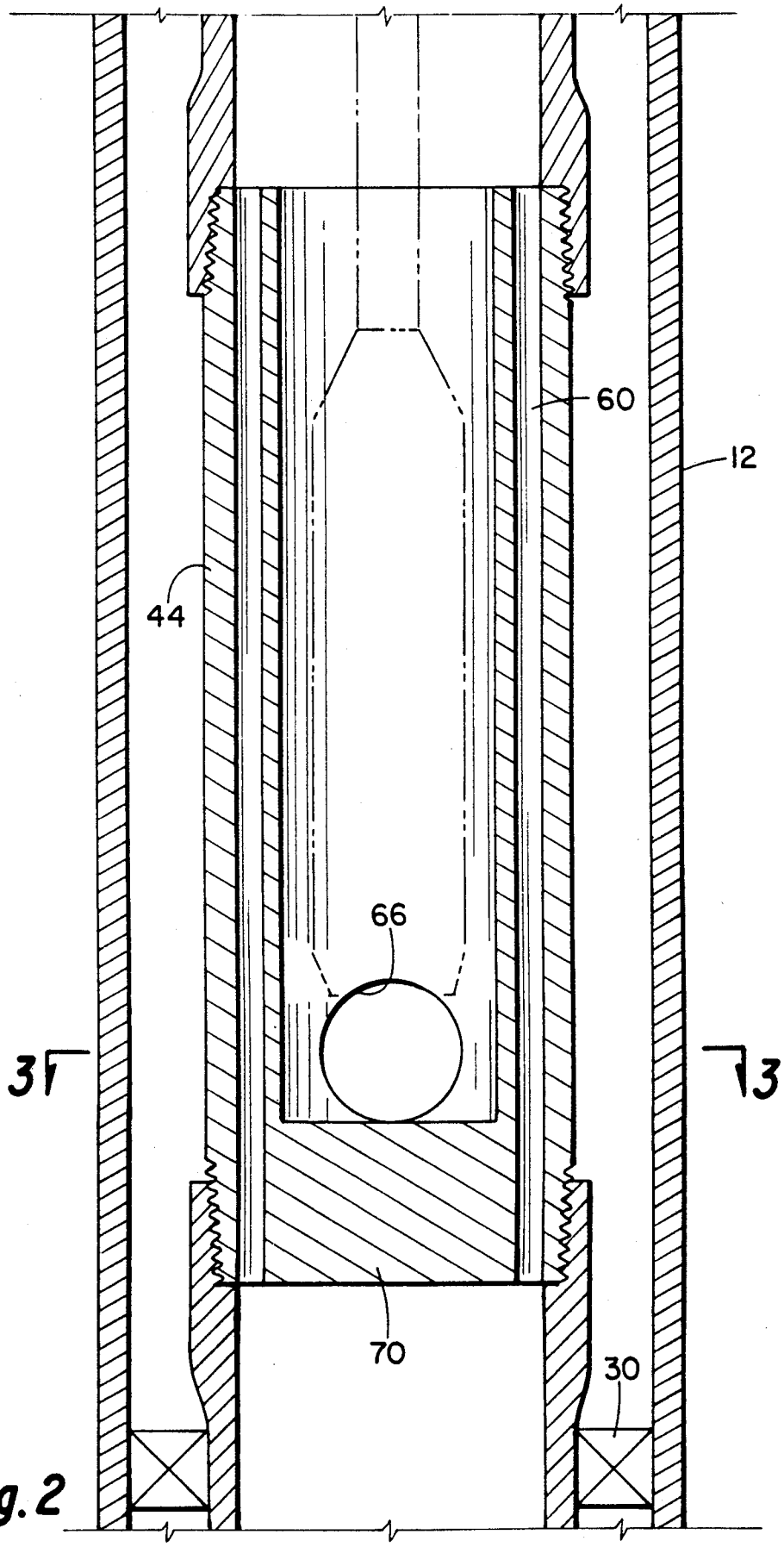
FIG. 2 is an enlarged view showing the downhole seating bypass tool of FIG. 1.

Bypass tool 44 is cylindrical and is provided with a plurality of longitudinal passages 60 in the wall thereof which extend from one end to the other and provides fluid communication between space 62 within tubing 40 and exterior pump 52 to the interior 64 of swage 48 which in turn is in direct communication with space 28 which is that space within casing 12 below packer 30. A plurality of ports 66 extend through the wall of bypass tool 44 to establish fluid communication between the interior 68 within the sleeve 44 and the annulus 24 between the casing and the tubing. As clearly shown in FIG. 3, these ports 66 do not intercept any of the vertical passages 60. It is also to be pointed out that the lower end of bypass tool 44 is closed by a seal or plug 70 which may be an integral part of the tool. The enlarged view of the bypass tool which is assembled into the system is shown in FIG. 2. This Figure and FIG. 3 are quite helpful in defining the location of the various vertical passages 60 and the side port 66.

A brief description of the operation of the assembly of FIG. 1 will now be given. It is assumed that zone 16 is productive of salt, water, or brine and hydrocarbon and that lower disposal zone 18 is available to receive water. Both gas and water are produced through perforations 22 as indicated by the arrows 72 and 74 respectively. The water and gas are separated by gravity with the gas flowing upwardly in annulus 24 to the surface where it flows through a wellhead into a natural gas gathering system in a well-known manner. The water flows downward as indicated by arrow 74. The water initially flows downwardly, but its bottom flow is stopped by packer 30. The water then flows inwardly through side ports 66 of bypass tool 44 and inwardly and upwardly to the intake of pump 52. The water is then pumped upwardly into the interior of tubing 14. As water builds up in tubing 14, it then flows downwardly through the longitudinal passages 60 in bypass tool 44 and out the bottom thereof into the space 28 below packer 30 as indicated by arrows 76. It then flows through perforations 26 into the disposal zone 18. The top of tubinq 14 is sealed or closable at the top in any well-known manner. Thus, the water pumped by the pump can only go into disposal zone 18 as described above. It does not have to be disposed at the surface.

This bypass tool assembly described above has been successfully used in two wells.

A bypass tool assembly as shown in FIG. 1, has been built with the following sizes in which the tubing 14 is $2\frac{7}{8}''$, collars 32 $2\frac{7}{8}''$, swedge 36 $3\frac{1}{2}''\times2\frac{7}{8}''$ male to male, collars 38 $3\frac{1}{2}''$, tubing 44 $3\frac{1}{2}''$, collar 42 $3\frac{1}{2}''$, seating nipple bypass tool 44 $3\frac{1}{2}''$with $1\frac{1}{2}''$bypass port 66 and 5/16" diameter longitudinal passages 60, collar 46 $3\frac{1}{2}''$, swedge 48 $3\frac{1}{2}''\times2\frac{7}{8}''$ male to male collar 47 $2\frac{7}{8}''$, J-latch on-off tool 50 $2\frac{7}{8}''$ and a $5\frac{1}{2}''$production packer 30. An assembly with sizes just set forth was used in the well of Case History I below. In Case History II the well was equipped with a $2\frac{7}{8}''$ seating nipple bypass tool. The two case histories illustrate that the described assembly is effective.

Case History I

The well in this case was drilled and completed in Texas County, Okla. in September of 1976. The well was perforated in what is known as Morrow L-1 sand and treated with 1,500 gallons of acid and fractured with 23,500 gallons gelled acid plus 23,500 pounds 10/20 sand. The well then tested for approximately 5.7 million cubic feet of gas plus 14.4 barrels of condensate and 2.4 barrels of water per day. The well produced from October 1976 to July of 1979 when the water production increased from approximately 7 to 200 barrels of water per day. The well continued to produce with a gradual increase in water production until July 1984 when the well ceased to produce due to high water production. The well was temporarily abandoned and then reactivated in February 1989, producing approximately 650,000 cubic feet of gas plus 350 barrels of water per day. Production declined rapidly, and the well ceased production again in August 1989. Pumping equipment was then installed in October 1989 to produce the water, and the well as then put back on production, making 300,000 cubic feet of gas plus 300 barrels of water per day.

By April 1990 the well was producing 300,000 cubic feet of gas plus 400 barrels water per day, at which time it became uneconomical to produce and was temporarily abandoned.

At this point it was determined that it would probably be economical to operate the well if the produced water was disposed of within the same well bore without pumping to the surface. In August 1990 the seating nipple bypass tool described herein had been developed and was installed. This design was very compact. The well was then put back on production, flowing approximately 50,000 to 100,000 feet of gas plus no barrels of water per day. After some adjusting of the pump speed (strokes per minute), the gas production increased to about 300,000 cubic feet of gas per day with no water being pumped to the surface. Since August 1990 through the month of February 1991, the well has accumulated 45.331 million cubic feet of gas with no salt water disposal costs. As the salt water is disposed downhole without lifting to the surface, there is no surface disposal costs or problems. The well is continuing to produce at an average rate of 300,000 cubic feet of gas per day.

Case History II:

This well was drilled and completed in Texas County, Okla. in February of 1987. The well is perforated in what is known as the Morrow L-3 Sand with no initial treatment. It was then tested for 1.7 million cubic feet of gas plus 1 barrel of condensate, plus trace of water per day. The well produced, with a gradual increase in water, until April of 1989. Then pumping equipment was installed to reduce the first buildup in the well bore and to increase gas production. In November of 1990 the well was producing approximately 50,000 cubic feet of gas plus 50 barrels of water per day. At this point the well was marginally profitable and was reviewed for the installation of the Seating Nipple Bypass Tool of the present invention. The Keys formation (a stratum below and separated from the Morrow L-3 Sand) was then perforated for use as a disposal zone, and the downhole equipment as described herein was then installed in February of 1991. The well was put back on production for 50,000 cubic feet of gas plus zero barrels of water per day produced to the surface. At this time there is no significant amount of accumulated production history since the well was recently completed.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for use in a subterranean well producing fluids such as hydrocarbon gas and water from a producing stratum, said well includes a water disposal stratum separated from said producing stratum which comprises:

a casing lining said well;

a tubing within said casing forming an annulus between it and said casing;

packing means sealing the annulus between said production stratum and said water disposal stratum; a pump located in and arranged to discharge fluid into said tubing;

means to actuate said pump;

a seating nipple bypass attached to the lower end of said tubing string, said bypass nipple having a) means to close said lower end, b) at least one longitudinal hole in its wall, and c) side port means establishing fluid communication between the annulus and the interior of said nipple bypass, the upper end of said longitudinal passage in fluid communication with the interior of said tubing and the lower end of said longitudinal passage opening into and in fluid communication with the space beneath said packer means whereby water pumped by said pump flows downwardly in said passage into said space and into said disposal stratum.

2. The apparatus of claim wherein said means to close said lower end is a removeable plug.

3. A bypass nipple for use in a subterranean well in which a tubing has been suspended which comprises:

a tubular member having at least one unobstructed longitudinal hole in the wall thereof, any such hole extending from one end of said tubular member to the other and at least one side port extending through the wall of said tubing but does not intercept any longitudinal passage, said side port permitting fluid flow in either direction;

means to connect said tubular member to said tubing wherein fluid may flow through said tubing and through said longitudinal hole(s); and a closure at one end of the tubular member.

* * * * *